US007161550B2

(12) United States Patent
McLean et al.

(10) Patent No.: US 7,161,550 B2
(45) Date of Patent: Jan. 9, 2007

(54) DUAL- AND QUAD-RIDGED HORN ANTENNA WITH IMPROVED ANTENNA PATTERN CHARACTERISTICS

(75) Inventors: James S. McLean, Austin, TX (US); Robert A. Sutton, Austin, TX (US)

(73) Assignee: TDK Corporation, Chiba (JP)

( * ) Notice: Subject to any disclaimer, the term of this patent is extended or adjusted under 35 U.S.C. 154(b) by 22 days.

(21) Appl. No.: 11/108,394

(22) Filed: Apr. 18, 2005

(65) Prior Publication Data

US 2005/0231436 A1 Oct. 20, 2005

Related U.S. Application Data

(60) Provisional application No. 60/563,965, filed on Apr. 20, 2004.

(51) Int. Cl.
*H01Q 13/00* (2006.01)

(52) U.S. Cl. ..... 343/786; 343/787

(58) Field of Classification Search ..... 343/786, 343/772, 787

See application file for complete search history.

(56) References Cited

U.S. PATENT DOCUMENTS 4,157,550 A * 6/1979 Reid et al. ..... 343/786
6,208,309 B1 3/2001 Chandler et al. ..... 343/786
6,208,310 B1 3/2001 Suleiman et al. ..... 343/786
6,320,554 B1 * 11/2001 Yuanzhu ..... 343/786
6,396,453 B1 5/2002 Amyotte et al. ..... 343/786
6,489,931 B1 12/2002 Liu ..... 343/786
2002/0113746 A1 * 8/2002 Strickland ..... 343/786
2002/0186174 A1 12/2002 Matsumoto et al. ..... 343/786
2003/0058182 A1 3/2003 Bhattacharyya et al. .... 343/786
2003/0210197 A1 * 11/2003 Cencich et al. ..... 343/786

* cited by examiner

*Primary Examiner*—Trinh Vo Dinh
(74) *Attorney, Agent, or Firm*—Kevin L. Daffer; Daffer McDaniel, LLP

(57) ABSTRACT

As provided herein, a dual- or quad-ridged broadband horn antenna may include a pair of conductive antenna elements arranged opposite one another for guiding an electromagnetic wave in a longitudinal direction through the horn antenna. In some cases, the pair of conductive antenna elements may include substantially convex inner surfaces and appropriately shaped outer surfaces. The convex inner surfaces may generally function to direct or guide the radiated energy without disturbing the intended radiation pattern. To maintain the intended radiation pattern, the broadband horn antenna may also include a pair of tapered extension elements, each coupled to an outer surface of a different one of the antenna elements at one end thereof. In some cases, a magnetic material may be arranged upon at least a portion of the antenna elements to restrict surface currents to flowing along the inner surfaces only. In some cases, longitudinal grooves may be formed within the inner surfaces to restrict surface currents from flowing in a direction transverse to the longitudinal direction.

24 Claims, 5 Drawing Sheets

DUAL- AND QUAD-RIDGED HORN ANTENNA WITH IMPROVED ANTENNA PATTERN CHARACTERISTICS

PRIORITY APPLICATION

This application claims priority to Provisional Application No. 60/563,965 filed Apr. 20, 2004 entitled "Dual- and Quad-Ridged Horn Antenna with Improved Antenna Pattern Characteristics."

BACKGROUND OF THE INVENTION

1. Field of the Invention

This invention relates to antenna design and, more particularly, to dual-ridged and quad-ridged broadband horn antennas.

2. Description of the Related Art

The following descriptions and examples are not admitted to be prior art by virtue of their inclusion within this section.

An antenna is a device which can radiate or receive electromagnetic (EM) energy. An ideal transmitting antenna receives power from a source (e.g., a power amplifier) and radiates the received power into space. That is, electromagnetic energy escapes from the antenna and, unless reflected or scattered, does not return. A practical antenna, however, generates both radiating and non-radiating EM field components. An example of a non-radiating EM field component would be the portion of the accepted power that is returned to the source, or otherwise dissipated in a resistive load.

The performance of an antenna can be characterized in a variety of ways. First, the radiation efficiency of an antenna (or "antenna efficiency") can be defined as the ratio of the amount of power radiated by the antenna to the amount of power accepted by the antenna (from a power source). The portion of the power accepted by the antenna, but not radiated, may be dissipated in the form of heat. Other antenna performance characteristics include the operating frequency bandwidth, gain, directivity and the antenna pattern.

As used herein, the "antenna radiation pattern" may be generally defined as the spatial distribution of a quantity, which characterizes the electromagnetic field generated by the antenna. The antenna pattern is usually given as a representation of the angular distribution (in spherical coordinates, θ and ϕ, at a fixed point, R, from the antenna) of one of the following quantities: power flux density, radiation intensity, directivity, gain, phase, polarization and field strength (electric or magnetic). For example, the "radiation pattern" of an antenna may represent the angular distribution of the radiated power flux density in the far field (i.e., the region of the field of an antenna where the angular field distribution is essentially independent of the distance from a specified point in the antenna region). For sinusoidal steady state fields, the radiation pattern may be formed by plotting the real part of the radial component of the Poynting vector:

$$W(\theta,\phi)=\frac{1}{2}\mathrm{Re}\left(\left[\vec{E}(\theta,\phi)\times\vec{H}*(\theta,\phi)\right]\cdot\hat{a}_R\right) \quad \text{[EQ. 1]}$$

where, $\vec{E}$ and $\vec{H}$ are vector phasor representations of the electric and magnetic fields, respectively. In other words, the radiation pattern can be described as the tendency of an antenna to radiate electromagnetic energy (including electric and magnetic field components) as a function of direction in the far field region.

Though the radiation pattern of an antenna may be presented as a 3-D plot over all spherical angles, it is often beneficial to provide 2-D "cuts" of the radiation pattern when examining quantitative information. These "cuts" are generally made along the so-called E- and H-planes of the EM field in the far field region. For a linearly polarized antenna, the E-plane is the plane containing the electric field vector ($\vec{E}$) and the direction of maximum radiation. The H-plane is similar, though orthogonal to the E-plane. An exemplary radiation pattern for a particular type of antenna will be described in more detail below.

The directivity, gain and polarization of an antenna may be computed with knowledge of an antenna's radiation pattern. The "directivity" of an antenna may be generally defined as the direction of maximum radiation. For example, the radiation pattern of most directional antennas may include one main lobe (pointing in the direction of maximum radiation), but may also include several smaller side lobes (due, e.g., to reflections or cross-polarizations within the antenna). These side lobes generally detract from the overall performance of the antenna by reducing the amount of EM energy radiated in the intended direction. The "gain" of a directional antenna may be defined as the directivity multiplied by the radiation efficiency of the antenna. Thus, the antenna gain will be less than the directivity for antenna designs, which provide less than 100 percent radiation efficiency (i.e., real antennas).

As noted above, electromagnetic fields are radiated from antennas as vector quantities. The behavior of the vector nature of an electromagnetic field is often referred to as the "polarization" or "polarization state" of an antenna. Most antenna designs used for Electromagnetic Compatibility (EMC) testing are linearly polarized, meaning that the electric (or magnetic) field components are confined to one plane. On the other hand, some antenna designs may exhibit an elliptical polarization, or radiation that is polarized predominantly in one plane with a slight cross-polarization component, which is out of phase with the principle component. In elliptical polarizations, the tip of the electric field vector may trace an elliptical pattern in any fixed plane intersecting, and normal to, the direction of propagation. An elliptically polarized wave may be resolved into two linearly polarized waves in phase quadrature, such that their polarization planes are at right angles to each other.

A dual-ridged horn antenna, or dual-ridged waveguide, is one example of a linearly polarized antenna. When heavily loaded, a dual-ridged waveguide can provide a significantly broad bandwidth (e.g., from about 1 GHz to about 18 GHz). As shown in FIGS. 1 and 2, a dual-ridge horn 100 may include a pair of antenna elements 110 (often referred to as "ridges" or "fins") arranged opposite one another within a rectangular-shaped horn antenna. Each of the antenna elements 110 may have a substantially convex inner surface 112 and a substantially straight outer surface 114. In most cases, each of outer surfaces 114 may be fixedly attached to one of the sidewalls 120 forming horn antenna 100. When coupled together, sidewalls 120 may form a rectangular-shaped cone structure having a substantially larger aperture 130 than base 140. In some cases, a rectangular-shaped box (or "cavity structure") 150 may be coupled to the similarly shaped base 140. The cavity structure may include a power connector 160 for supplying electrical current from a power source (not shown) to the pair of antenna elements via a coaxial transmission line (not shown). A conductive feed line 170 may also be provided to transfer the electrical current from the coaxial transmission line to the pair of antenna elements 110 of the horn antenna. The transition from the transmission line to the conductive feed line 170 is an important part of the horn in that it comprises part of the horn's feed region (i.e., the region at which power is supplied to the antenna elements). When power is supplied, the inner surfaces 112 of the antenna elements function as tapered waveguides to guide the radiated energy as it travels from base 140, through the "throat" of the horn antenna, and out through the "mouth" or aperture 130 of the antenna.

Conventional broadband horn antennas used in EMC test systems typically demonstrate an operating frequency range of approximately 1 GHz to 18 GHz. However, the upper frequency range is often beset with anomalies in the radiation pattern. As the frequency increases, these so-called anomalies may surface as an increase in side lobes (180, FIG. 3), an increase in back lobes (185), or even the splitting or modification of the main lobe (190). At the highest end of the frequency range, the radiation pattern is primarily controlled by the characteristics of the feed region of the horn. For example, as the frequency increases, electromagnetic energy tends to pull further and further away from the inner surfaces 112 of the antenna elements. Such pulling away begins at the "mouth" of the antenna and gradually increases until the energy begins to pull away at successfully shorter distances from the feed region. This tends to increase the amount of transverse current on the inner surfaces of the antenna elements, and higher-order modes to develop in the feed region. In some cases, the higher-order modes may detract from the intended radiation pattern by redirecting a substantial amount of energy into side lobes and/or back lobes.

At least one horn antenna design has been proposed in which a device for suppressing higher-order modes in the feed region has been incorporated. This device essentially amounts to a strip-like conductor placed in between the two ridges (i.e., antenna elements 110) of the horn antenna. This device is somewhat effective in suppressing higher-order modes and represents an improvement over earlier designs, which failed to address mode suppression altogether. However, due to tolerance constraints, the strip-like conductor fails to provide a viable solution to the radiation pattern anomalies at all times. For example, the strip-like conductor must be symmetrically arranged between the ridges with an exceptionally tight tolerance. Not only is this difficult to accomplish in dual-ridged antenna designs, but it becomes exceedingly so in quad-ridged antenna designs, due the even tighter space constraints imposed within the feed region.

A quad-ridged horn antenna is basically a dual-polarized version of a dual-ridged horn antenna and functions, in the ideal case, by exploiting the orthogonality of two modes in the quad-ridged waveguide. In other words, quad-ridged horn antennas combine two linearly polarized waves to produce an elliptically polarized waveguide. As noted above, an elliptically polarized wave is polarized predominantly in one plane with a slight cross-polarization component that is not in phase with the principle component. Though careful design may minimize the cross-polarization component, it cannot completely eliminate it. In a practical situation, coupling between the two modes, especially in the feed region, is inescapable and detracts from the horn antenna's performance. Because of various difficulties in implementing the feed region (e.g., space constraints), quad-ridged horns have not been able to provide the same bandwidth as dual-ridged, single-polarization horns. At best, conventional quad-ridged horn antennas may provide an operating frequency range of about 1 GHz to about 10 GHz.

In addition to reduced operating frequency range, conventional dual- and quad-ridged horn antennas are often plagued with anomalies in the lower frequency ranges. At the low end of the operating frequency range, the characteristics of the "mouth" tend to control the radiation pattern of the dual- and quad-ridged horn antennas. Moreover, reflections from the "mouth" may cause great fluctuations in the "throat" impedance and significant pulse distortion. At the lowest end of the frequency range, current may flow around the edge of the "mouth" to increase the number of side lobes and back lobes in the radiation pattern. This may ultimately destroy the unidirectional properties of the horn.

Therefore, a need exists for improved dual-ridged and quad-ridged horn antenna designs that provide enhanced control of the intended radiation pattern over a maximized operating frequency range.

SUMMARY OF THE INVENTION

The problems outlined above may be in large part addressed by a dual- or quad-ridged broadband horn antenna including at least one pair of conductive antenna elements arranged opposite one another for guiding an electromagnetic wave through the horn antenna. In some cases, the pair of conductive antenna elements may be formed to include substantially convex inner surfaces and substantially straight outer surfaces, although alternative shapes and configurations may be used, if so desired. In some cases, the convex inner surfaces may help direct or guide the radiated electromagnetic energy through the antenna elements without significantly deviating from an intended radiation pattern. The broadband horn antenna may or may not include the sidewall structures, which are typically coupled to the outer surfaces of the antenna elements.

In some embodiments, the broadband horn antenna may include a pair of tapered extension elements, each being coupled to an outer surface of a different one of the pair of conductive antenna elements at one end thereof. In some cases, the pair of tapered extension elements may extend from respective outer surfaces of the antenna elements in opposite directions and along an axis, which is perpendicular to a longitudinal axis separating the antenna elements. Thus, the tapered extension elements may be incorporated within the broadband horn antenna design for suppressing current flow along the outer surfaces of the antenna elements.

In some embodiments, the broadband horn antenna may include a magnetic material arranged upon at least a portion of the pair of conductive antenna elements. The magnetic material may be chosen and arranged, such that surface currents are restricted to flowing along the inner surfaces of the antenna elements only. In other words, the magnetic material may help maintain surface current flow primarily in a longitudinal, rather than transverse direction. In some cases, the magnetic material may include substantially any magnetic material with a relative permeability greater than 1.0. In a particular embodiment, the magnetic material may include a magnetic coating formed by embedding high impedance magnetic particles within an elastomer. Other possibilities for the magnetic material are contemplated herein.

In some embodiments, the broadband horn antenna may include longitudinal grooves formed within the inner surfaces of the pair of conductive antenna elements. For example, the longitudinal grooves may extend upwards from a base of the pair of conductive antenna elements, and may function to restrict surface currents from flowing along the pair of conductive antenna elements in a transverse direction. In some cases, the longitudinal grooves may extend along only a portion of the inner surface and gradually decrease in depth as the longitudinal grooves extend away from the base of the conductive antenna elements. In other cases, however, the longitudinal grooves may extend along an entire length of the inner surface. In some cases, a plurality of longitudinal grooves may be formed within the inner surfaces of each antenna element. The plurality of longitudinal grooves may be uniformly spaced and substantially parallel to one another. Alternative spacings are also contemplated herein.

In some embodiments, the broadband horn antenna may include a cavity structure integrated within, or otherwise coupled to, a base of the pair of conductive antenna elements. Such a cavity structure may include at least one input connector for supplying current to the pair of conductive antenna elements. In some cases, a balanced input may be coupled to the at least one input connector for supplying equal and opposite levels of current to the pair of conductive antenna elements. The balanced input may improve radiation characteristics by improving symmetry and impedance matching between the pair of conductive antenna elements. In addition, a layer of magnetic material may be formed within the cavity structure for suppressing cavity resonances and radiation pattern disturbances therein.

BRIEF DESCRIPTION OF THE DRAWINGS

Other objects and advantages of the invention will become apparent upon reading the following detailed description and upon reference to the accompanying drawings in which.

Figure 1:
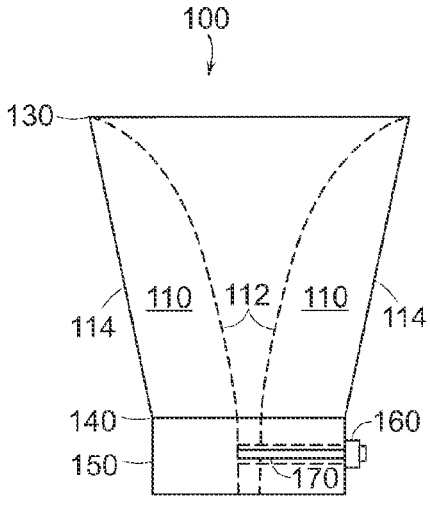
FIG. 1 is a side view of a conventional dual-ridged horn antenna.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Turning to the drawings, exemplary embodiments of a dual-ridge and quad-ridge horn antenna are shown in FIGS. 4–11. As will be described in more detail below, the antenna design provided herein improves upon conventional designs by: (i) modifying the contour of the antenna elements to include tapered extension elements at the mouth of the antenna, (ii) the use of a relatively high impedance magnetic material on the antenna elements for the purpose of controlling, directing, channeling or otherwise guiding the surface currents in a direction conducive to radiation from the horn antenna, (iii) the use of longitudinal grooves formed within the antenna elements to suppress high-order modes in the feed region, (iv) the use of a high impedance and/or lossy magnetic material to suppress higher-order modes in the feed region, and (v) the use of a complementary, balanced feed for supplying equal and opposite amounts of current to the antenna elements, thus, reducing cross-polarizations (by enhancing symmetry) in a dual- or quad-ridged horn with or without conducting side walls.

It should be understood that it may not be necessary to include all of the above-mentioned improvements in all embodiments of the invention. Instead, some embodiments of the invention may include only one, or possibly several, of the improvements set forth above. Though exemplary embodiments are shown in FIGS. 4–11, one skilled in the art would readily understand how various aspects of the invention could be combined to produce alternative embodiments, which may not be explicitly shown in the drawings or described herein. The invention is intended to cover all such possible combinations.

Figure 4:
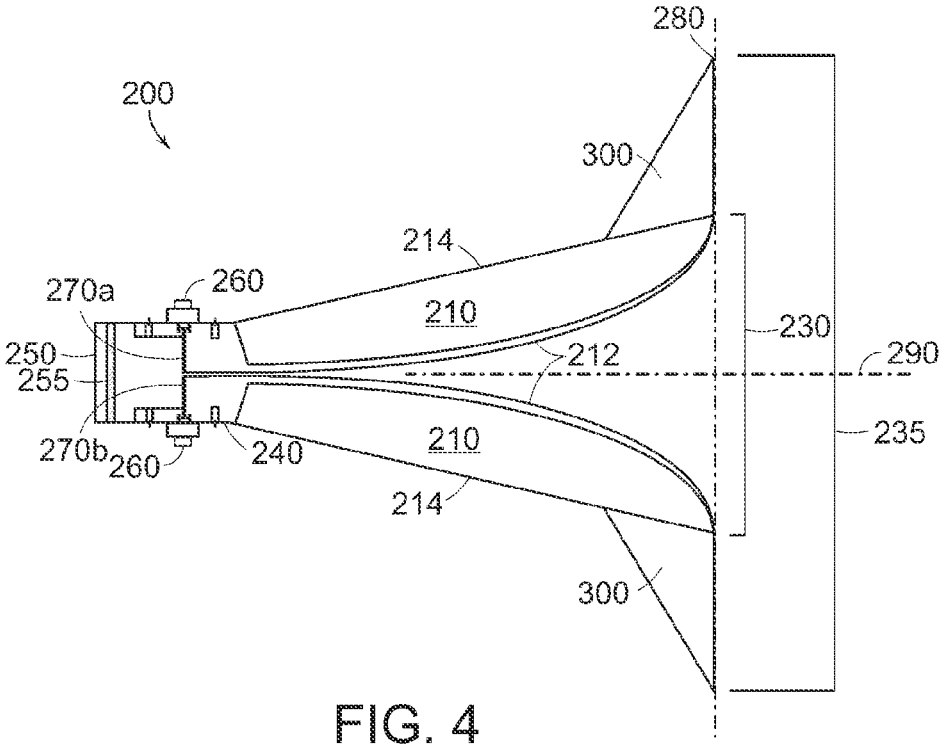
FIG. 4 is a cross-sectional view of a dual-ridged or quad-ridged horn antenna, according to one embodiment of the invention.
Figure 6:
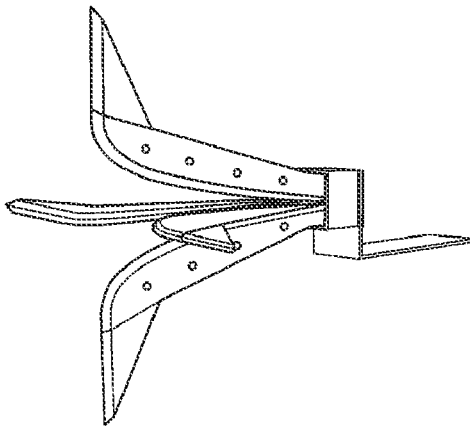
FIG. 6 is a rotated, three-dimensional side-view of a quad-ridged horn antenna, according to one embodiment of the invention.
Figure 7:
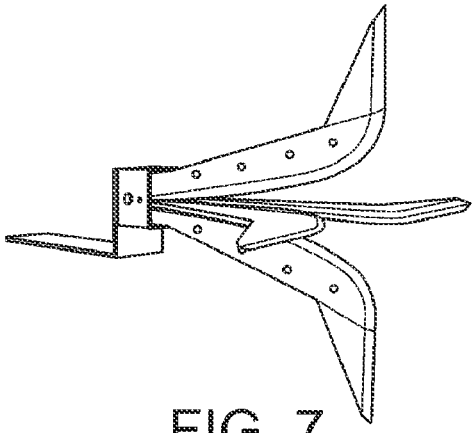
FIG. 7 is another rotated, three-dimensional side-view of the quad-ridged horn antenna shown in FIG. 6.
Figure 8:
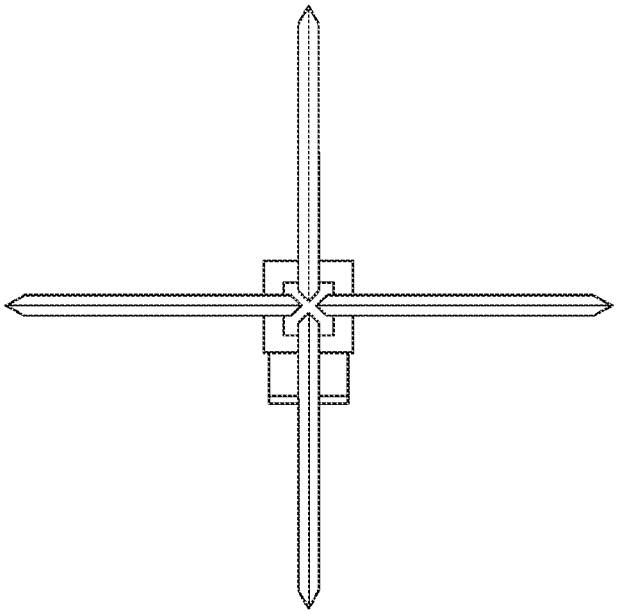
FIG. 8 is a front view of the quad-ridged horn antenna shown in FIG. 6.

FIG. 4 is a cross-sectional view of a dual-ridged horn antenna 200 including a pair of conductive antenna elements 210 arranged opposite one another for guiding the electromagnetic energy radiated from the horn antenna. As used herein, antenna elements 210 may be otherwise referred to as "ridges" or "fins" of the horn antenna, and may be constructed from substantially any conductive material. As shown in FIGS. 6–8, a quad-ridged horn may be alternatively provided by adding another pair of antenna elements, such that adjacent antenna elements are arranged substantially 90° apart.

Regardless of whether a dual-ridged or quad-ridged horn is provided, antenna elements 210 may be closely coupled at a base 240 of the antenna and may curve away from one another to form a slightly larger aperture 230. A rectangular-shaped box (or "cavity structure") 250 may be integrally formed, or otherwise coupled to, the similarly shaped base 240. The cavity structure may include at least one power connector 260 for supplying electrical current from a power source (not shown) to the pair of antenna elements 210 via a coaxial transmission line (not shown). A pair of conductive feed lines 270*a,b* may also be provided to transfer the electrical current from the coaxial transmission line to the pair of antenna elements 210 at the feed region. Therefore, unlike the conventional horn antenna 100 shown in FIGS. 1–2, horn antenna 200 may be supplied with a balanced feed to enhance the symmetry of the horn antenna.

In one embodiment, a relatively high impedance magnetic material 255 may be formed within cavity structure 250 to suppress higher-order modes in the feed region. In other words, the presence of a magnetic material in the cavity structure may suppress cavity resonances and radiation pattern disturbances. For reasons described in more detail below, the magnetic material chosen for the cavity may include substantially any magnetic material with a relative permeability greater than 1.0.

Similar to conventional designs, antenna elements 210 may include substantially convex inner surfaces 212 and substantially straight outer surfaces 214. Though the configuration of the outer surfaces is somewhat less important (and may be straight to simplify the design), the contour of the inner surfaces preferably functions to guide or direct the electromagnetic energy radiated from the horn antenna. In an ideal situation, substantially all of the incident energy (i.e., the energy supplied to the feed region) will be launched/radiated from the horn antenna. To improve the radiation pattern, the current distribution on the horn antenna may be better controlled by extending the ridge contour to a line 280 that is perpendicular to the longitudinal axis 290 of the horn. This may be particularly useful at the low end of the horn antenna's operating frequency range, where the aperture 230 or "mouth" of the antenna tends to have more influence over the radiation pattern.

As shown in FIG. 4, a pair of tapered extension elements 300 may be integrated onto, or otherwise coupled to, the antenna elements 210. In a particular embodiment, each of the extension elements 300 may be coupled to an outer surface 214 of a different one of the pair antenna elements 210 at one end thereof. The pair of tapered extension elements may extend from respective outer surfaces of the antenna elements in substantially opposite directions. As shown in FIG. 4, the direction of extension is along the line 280 perpendicular to the longitudinal axis 290 separating the pair of antenna elements 210. By adding the pair of tapered extension elements 300, the ridge contour may be extended to provide a unique, frequency-dependent equivalent aperture 235. Such an aperture may greatly improve the performance of horn antenna 200 in the lower frequency range by helping to maintain a more highly controlled radiation pattern with minimal side lobes and back lobes. In other words, tapered extension elements 300 may prohibit current from flowing onto the outer surfaces 214 of the antenna elements; the occurrence of which reduces the amount of energy radiated in the intended direction by increasing the amount of energy redirected into side lobes and/or back lobes.

In some embodiments, tapered extension elements 300 may be separately formed and fixedly attached to the outer surfaces 214 of the pair of antenna elements 210. For purposes of simplicity, it is generally preferred that the antenna elements and extension elements be formed from the same material. It is contemplated that substantially any mechanical means may be used for attaching the extension elements to the outer surfaces of the antenna elements. In one example, the tapered extension elements 300 may be attached to the outer surfaces 214 by means of one or more screws; although, alternative means of mechanical attachment may be used (e.g., solder, adhesives, etc.). In some cases, physical discontinuities may exist between the contact surfaces of the antenna elements and the extension elements attached thereto. These physical discontinuities may result in (minor) electrical discontinuities, which may disturb current flow at the contact surfaces. For this reason, the tapered extension elements 300 may be formed integral with the outer surfaces 214 of the antenna elements 210, in preferred embodiments of the invention. For example, the antenna elements may be fabricated (e.g., etched or cut from a sheet of conductive material) to include the tapered extension elements.

In some cases, the shape of the tapered extension elements may be modified from the illustrated shape shown in FIGS. 4–9. For example, the degree of taper or the length of the extension elements may be altered to further impede current flow along the outer surface of the antenna elements. Furthermore, sharp edges may be eliminated from alternative designs to reduce or eliminate the electrical discontinuities (and thus, the diffractions) that tend to occur at such edges. In addition to alternative shapes, the material composition and/or thickness of the tapered extension elements may be altered to produce a desired result.

In some cases, the thickness of the antenna elements (and thus, the thickness of the extension elements) may be reduced to improve radiation characteristics within a particular operating frequency range. For example, the antenna elements may be formed from a conductive sheet approximately ⅜ inches thick when the intended operating frequency range falls between about 1 GHz to about 20 GHz. However, reducing the thickness of the antenna elements (e.g., to about ¼ inches thick) may actually improve radiation characteristics (especially in higher operating frequency ranges) by increasing the impedance in the feed region.

When power is supplied to the horn, the inner surfaces 212 of the antenna elements guide the radiated energy as it travels from base 240 to the "mouth" or aperture 230 of the horn antenna. To improve the radiation pattern at higher frequencies, the antenna elements of horn antenna 200 may be resistively and/or magnetically loaded to provide a monotonically increasing surface impedance, which reduces the amount of redirected energy as the electromagnetic wave travels the length of antenna elements 210. By loading the antenna elements with a magnetic material, the antenna design described herein greatly improves pulse reproduction in a relatively small package (i.e., without increasing the size of the horn antenna).

Figure 5:
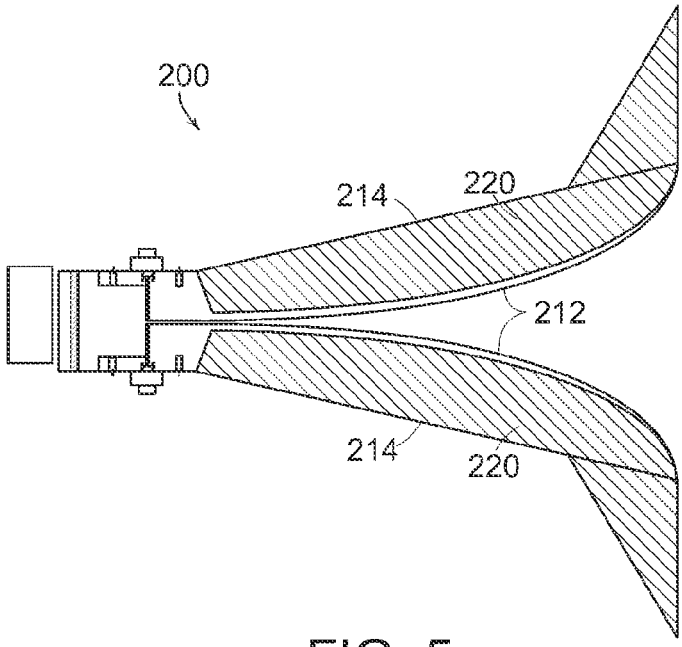
FIG. 5 is a cross-sectional view of the horn antenna of FIG. 4 with a magnetic material arranged upon at least a portion of the antenna.

As shown in FIG. 5, for example, surface current flow on the ridges may be controlled by incorporating a relatively high impedance magnetic material 220 onto at least a portion of the antenna elements 210. In general, the magnetic material may be included to restrict the surface currents to flowing primarily along the inner surfaces 212 of the antenna elements. As such, magnetic material 220 may extend from the outer surfaces 214, stopping just short of inner surfaces 212. By locally increasing the surface resistance of a majority of the antenna element, the currents are "choked off" and forced to take the path of least resistance—i.e., the portion of the ridge not covered by magnetic material 220. In this manner, the magnetic material may impede or restrict surface current flow in directions other than the intended (longitudinal) direction, as well as introduce loss in the transverse direction. Both mechanisms function to diminish the surface currents that would exist on the portion of the ridges away from the interior edge, where it is desirable for the current to flow. As a consequence, the incorporation of magnetic material 220 may further assist in maintaining a more highly controlled radiation pattern.

The magnetic materials chosen for ridges 210 and/or cavity structure 250 may be such that the intrinsic impedance of the chosen material is significantly greater than that of free space. For this to be true, the relative permeability of the material should be greater than 1.0, and should also be greater than the relative permittivity (i.e., the dielectric constant), so that the material acts as an inductive coating when it is "electrically thin". In the microwave range, a magnetic material with a relative permeability of about 1.5–20 may be used for magnetically loading the ridges. This would enable the magnetic material to exhibit magnetic losses in regions away from the inner surfaces, while providing the ability to direct or channel surface current flow along the inner surfaces of the ridges. Since the magnitude of the intrinsic impedance is thought to be of principal importance, the magnetic permeability of the material can be complex (i.e., a lossy material).

In some cases, the magnetic material for ridges 210 and/or cavity structure 250 may be chosen from substantially any magnetic material with a relative permeability greater than 1.0. However, the magnetic material need not be isotropic or homogeneous in order to guide or channel the current along the inner surface of the ridge. In fact, it may be advantageous to employ an inhomogeneous layered magnetic material, in some embodiments of the invention. For example, the magnetic material may actually comprise a flexible magnetic coating or sheets of magnetic material, which may be produced by embedding relatively high impedance magnetic particles (such as hexagonal ferrites) within an elastomer (such as silicon). These so-called anisotropic magnetic materials may be used to provide superior performance (over that of isotropic materials, such as cubic ferrites) at higher operating frequencies.

Figure 9A:
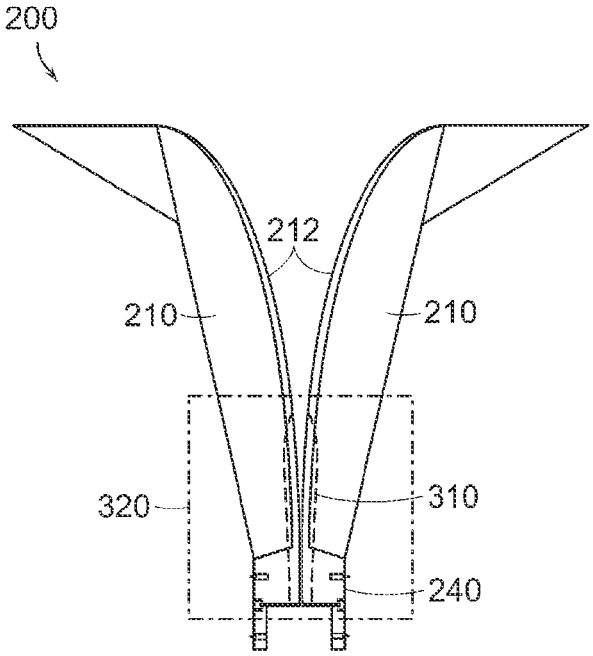
FIG. 9A is a cross-sectional view of the horn antenna of FIG. 4 with longitudinal grooves running the length of at least a portion of the antenna.
Figure 10:
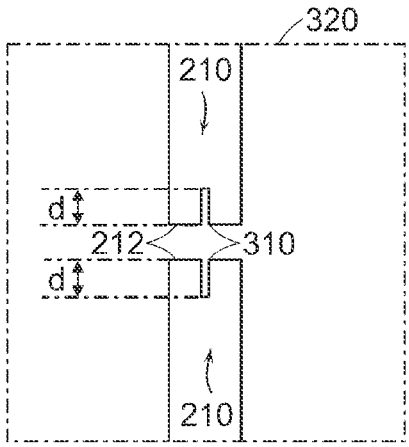
FIG. 10 is a top view of longitudinal grooves formed within a dual-ridged horn antenna, according to one embodiment of the invention.
Figure 11:
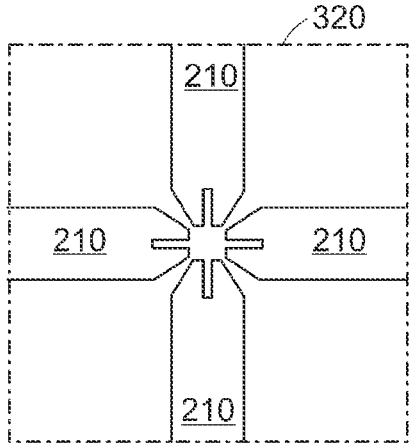
FIG. 11 is a top view of longitudinal grooves formed within a quad-ridged horn antenna, according to one embodiment of the invention.
Figure 9B:
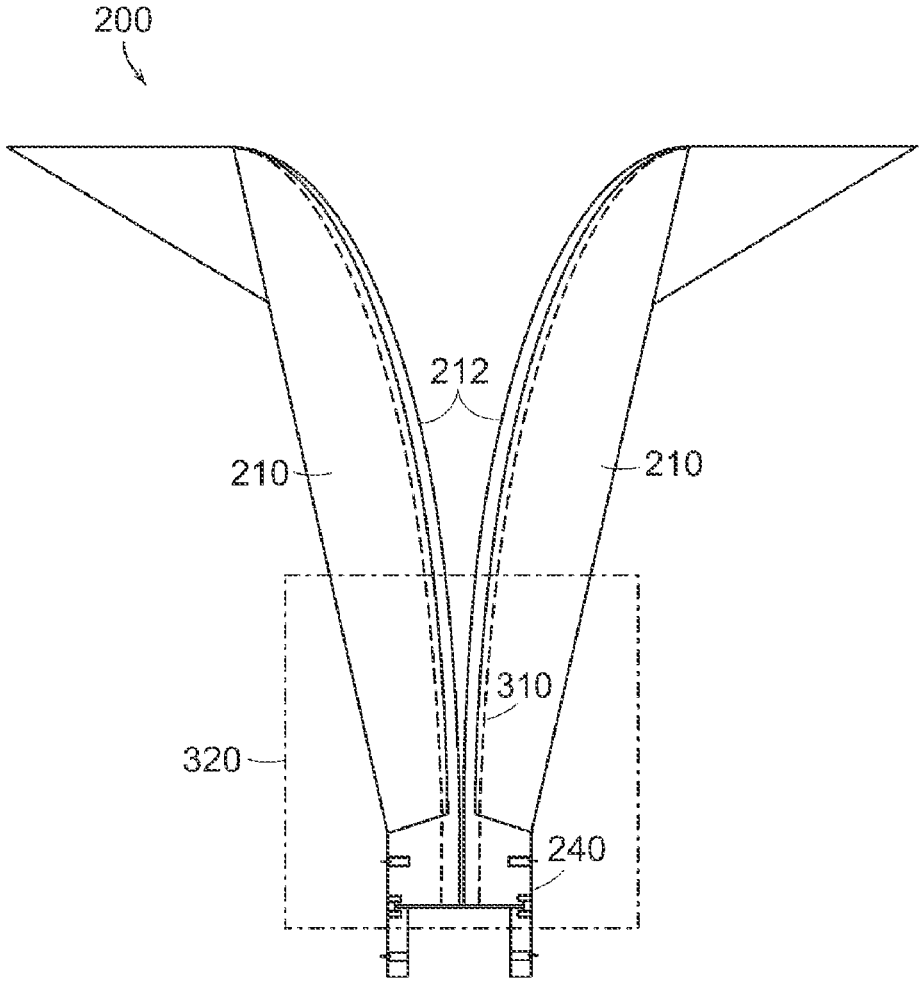
FIG. 9B is a cross-sectional view of the horn antenna of FIG. 4 with longitudinal grooves running along an entire length of the inner surface of the antenna.

FIGS. 9–11 illustrate one embodiment of the longitudinal groove structures 310 that may be formed within the inner surfaces 212 of the antenna elements. Generally speaking, groove structures 310 may extend upwards from the base of the pair of antenna elements 210, and thus, may function to suppress transverse surface currents, which tend to develop in the higher frequency ranges. In some cases, longitudinal grooves 310 may extend along only a portion of the inner surfaces 212, as shown in FIG. 9A. For example, the grooves may be formed near the base of the antenna elements (i.e., near the feed region) to prevent higher order modes from developing therein. The grooves may (or may not) gradually decrease in depth as the grooves extend away from the base of the antenna elements. In other cases, longitudinal grooves 310 may extend along the entire length of the inner surfaces 212, as shown in FIG. 9B. Although it may only be necessary to suppress transverse current near the feed region (e.g., to prevent higher order modes from developing), extending the grooves along the entire length may (at the very least) simplify the fabrication process. If the grooves are extended along the entire length, they may be formed with a uniform depth or a gradually decreasing depth, if so desired.

FIGS. 10 and 11 illustrate exemplary longitudinal grooves 310 that may be included within the dual-ridged and quad-ridged horn antenna designs, respectively. For example, FIG. 10 shows a top-side view (e.g., looking down into imaginary box 320) of exemplary longitudinal grooves 310 that may be formed within the inner surfaces 212 of a dual-ridged horn. In some cases, the grooves 310 may be formed to a depth (d), which is approximately equal to one-quarter wavelength of a particular operating frequency. For example, and as described in more detail below, the depth of the grooves may be substantially equal to one-quarter of the operating frequency wavelength at which transverse surface currents tend to be strongest. Though illustrated as having straight sidewalls and corners, longitudinal grooves 310 may be alternatively configured to include a relatively rounded contour without corners to simplify the fabrication process. In some cases, the depth of the grooves may gradually decrease as shown, for example, in FIGS. 9A and 9B. However, the depth of the grooves may be somewhat consistent, in other embodiments of the invention (not shown).

FIG. 11 differs from FIG. 10 by showing exemplary longitudinal grooves 310 that may be formed within the inner surfaces 212 of a quad-ridged horn. The longitudinal grooves of FIG. 11 may be formed to a similar or dissimilar depth (d), depending on design specifications, and may extend along an entire length of the inner surfaces, or only a portion. Unlike FIG. 10, the inner surfaces of the antenna elements 210 shown in FIG. 11 may be tapered, so as to accommodate all four antenna elements within the tight space constraints imposed by the feed region. In some cases, the relatively blunt inner surfaces of the dual-ridged horn embodiment (FIG. 10) may also be tapered to reduce the size of the feed region (e.g., by reducing the space between the antenna elements), which may enable higher operating frequencies.

In general, longitudinal grooves 310 may be incorporated into the dual-ridged or quad-ridged horn design to discriminate against transverse currents that tend to develop along the surface of the antenna elements. For example, surface currents may be primarily concentrated on the inner surfaces of the ridges or fins during low frequency operation. The surface currents are directed longitudinally along the ridges, and travel from the base, through the "throat" to radiate outwards from the "mouth" of the horn antenna. However, due to the complexity of the feed region (i.e., the region near the base where current is supplied to the antenna elements), some amount of current may be excited in a direction, which is transverse to the longitudinal direction (i.e., the intended direction of maximum radiation). The phenomenon is usually insignificant at lower operating frequencies. At higher frequencies, however, transverse surface currents may excite a guided wave that may propagate down the length of the horn. This guided wave may ultimately destroy the radiation pattern by (1) introducing a cross polarization component, which is not in phase with the principle component, and/or (2) causing significant amounts of energy to be redirected into side lobes and/or back lobes. In some cases, longitudinal grooves may be used alone, or in combination with a magnetic coating on the fins, to suppress transverse currents and minimize side lobe and back lobe formation.

The longitudinal grooves may be most effective at those frequencies where the transverse currents tend to be strongest. For example, transverse currents may peak at about 15–16 GHz when the horn operating frequency range lies between about 1–18 GHz. In an extreme case, the transverse currents may result in increased side lobes, increased back lobes, or even splitting of the main lobe. However, transverse currents may be significantly reduced or eliminated by forming longitudinal grooves within the fins. In a preferred embodiment, a depth of the longitudinal grooves may be approximately equal to one-quarter of the wavelength at which the peak transverse current occurs; although, alternative depths may suffice in other embodiments of the invention. In a more general embodiment, the depth of the longitudinal grooves may be approximately equal to ½ the thickness of the antenna elements.

Figure 2:
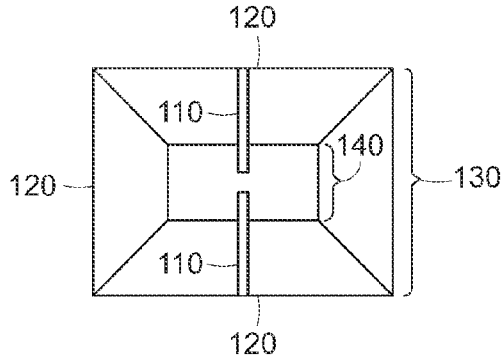
FIG. 2 is a top view of a conventional dual-ridged horn antenna.
Figure 3:
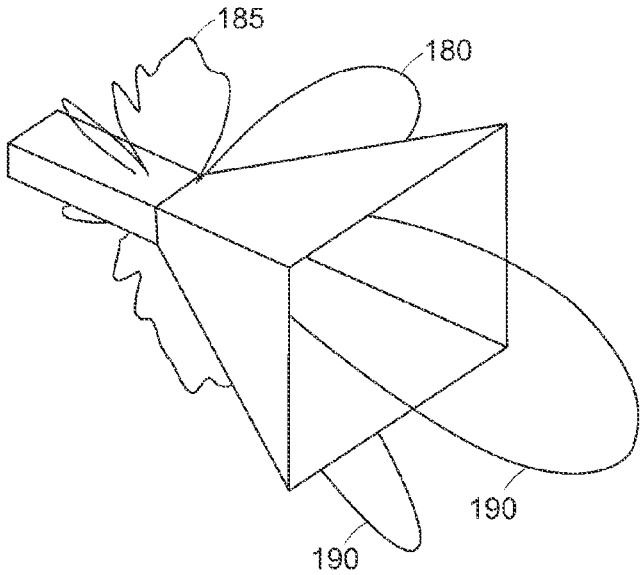
FIG. 3 is a two-dimensional radiation pattern plot of a conventional dual-ridged horn antenna.

As shown in FIGS. 4–9, the antenna designs provided herein may remove the side walls (120) typically included in conventional horn antennas (FIGS. 1–2). Because surface currents are primarily concentrated on the edges of the ridges (i.e., the antenna elements), the effects of the side walls are minimal. In some cases, the presence of the conducting side walls may actually detract from the intended radiation pattern of a dual-ridged or quad-ridged horn by introducing a cross-polarization component that detracts from the intended polarization. For example, the side walls may detract from the true Transverse Electromagnetic (TEM) nature of the fundamental mode generated within the cross-section of the horn. Thus, it may be desirable, in some cases, to construct the horn antenna with only ridges and no side walls, as shown in FIGS. 4–9. Such a horn would, in fact, be a true TEM structure (i.e., a structure where E- and H-fields are transverse to the direction of propagation). However, the antenna designs provided herein may be alternatively formed to include side walls, if so desired.

It will be appreciated to those skilled in the art having the benefit of this disclosure that this invention is believed to provide a dual-ridged and quad-ridged horn antenna with enhanced control of the intended radiation pattern over a maximized operating frequency range. Further modifications and alternative embodiments of various aspects of the invention will be apparent to those skilled in the art in view of this description. For example, there are many variables within each component (e.g., the cavity, feed region, ridges, tapered extension elements, etc.) of the horn antenna that can be altered to produce a different result. It is intended, therefore, that the following claims be interpreted to embrace all such modifications and changes and, accordingly, the specification and drawings are to be regarded in an illustrative rather than a restrictive sense.

What is claimed is:

1. A broadband horn antenna, comprising:

a first pair of conductive antenna elements arranged opposite one another, wherein the pair of conductive antenna elements each comprise an inner surface for guiding an electromagnetic wave and an outer surface arranged opposite to the inner surface; and a first pair of tapered extension elements, each coupled to an outer surface of a different one of the pair of conductive antenna elements at one end thereof, wherein the pair of tapered extension elements extend from respective outer surfaces in opposite directions and along an axis, which is perpendicular to a longitudinal axis separating the pair of conductive antenna elements.

2. The broadband horn antenna of claim 1, wherein the first pair of tapered extension elements are fixedly attached to the outer surfaces of the first pair of conductive antenna elements.

3. The broadband horn antenna of claim 1, wherein the first pair of tapered extension elements are formed integral with the outer surfaces of the first pair of conductive antenna elements.

4. The broadband horn antenna of claim 1, wherein no additional structures, other than the tapered extension elements, are coupled to the outer surfaces of the first pair of conductive antenna elements.

5. The broadband horn antenna of claim 1, wherein the inner surfaces of the first pair of conductive antenna elements are substantially convex in shape, wherein the outer surfaces are substantially straight.

6. The broadband horn antenna of claim 5, further comprising a magnetic material arranged upon at least a portion of the pair of conductive antenna elements to restrict surface currents to flowing only along the inner surfaces of the first pair of conductive antenna elements.

7. The broadband horn antenna of claim 5, further comprising longitudinal grooves formed within the inner surfaces of the first pair of conductive antenna elements, wherein the longitudinal grooves extend upwards from a base of the first pair of conductive antenna elements and function to impede surface currents from flowing along the first pair of conductive antenna elements in a transverse direction.

8. The broadband horn antenna of claim 5, further comprising a cavity structure integrated with, or otherwise coupled to, a base of the first pair of conductive antenna elements, wherein the cavity structure comprises at least one input connector for supplying current to the first pair of conductive antenna elements.

9. The broadband horn antenna of claim 8, further comprising a magnetic material formed within the cavity structure to suppress cavity resonances and radiation pattern disturbances.

10. The broadband horn antenna of claim 8, further comprising a balanced input feed coupled to the at least one input connector and configured for supplying equal and opposite levels of current to the pair of conductive antenna elements.

11. The broadband horn antenna of claim 10, further comprising a second pair of conductive antenna elements, similar to the first, arranged opposite one another and comprising convex inner surfaces and substantially straight outer surfaces, wherein the second pair of conductive antenna elements comprise a second pair of tapered elements, similar to the first, and wherein the first and second pairs of conductive antenna elements are arranged to provide a dual-polarization electromagnetic wave.

12. A broadband horn antenna, comprising:

a pair of conductive antenna elements arranged opposite one another, wherein the pair of conductive antenna elements comprise inner surfaces for guiding an electromagnetic wave and outer surfaces arranged opposite to the inner surfaces; and a magnetic material arranged upon at least a portion of the pair of conductive antenna elements, so as to restrict surface currents to flowing along the inner surfaces only.

13. The broadband horn antenna of claim 12, wherein the magnetic material comprises a relative permeability greater than 1.0.

14. The broadband horn antenna of claim 13, wherein the magnetic material comprises a magnetic coating formed by embedding high impedance magnetic particles within an elastomer.

15. The broadband horn antenna of claim 13, further comprising a pair of tapered extension elements, each coupled to an outer surface of a different one of the pair of conductive antenna elements at one end thereof, wherein the pair of tapered extension elements extend in opposite directions along an axis, which is perpendicular to a longitudinal axis separating the pair of conductive antenna elements, and wherein the pair of tapered extension elements function to suppress current flow along the outer surfaces.

16. The broadband horn antenna of claim 15, wherein no additional structures, other than the tapered extension elements, are coupled to the outer surfaces of the first pair of conductive antenna elements.

17. A broadband horn antenna, comprising:

a pair of conductive antenna elements arranged opposite one another, wherein the pair of conductive antenna elements comprise convex inner surfaces for guiding an electromagnetic wave in a longitudinal direction from a base to an aperture of the antenna elements; and at least one longitudinal groove formed within each inner surface of the pair of conductive antenna elements, wherein the longitudinal grooves extend upwards from the base of the antenna elements and function to impede surface currents from flowing along the antenna elements in a direction transverse to the longitudinal direction.

18. The broadband horn antenna of claim 17, wherein the at least one longitudinal groove extends along an entire length of the inner surfaces.

19. The broadband horn antenna of claim 17, wherein the at least one longitudinal groove extends along only a portion of each inner surface and gradually decreases in depth as the longitudinal grooves extend away from the base of the antenna elements.

20. The broadband horn antenna of claim 17, wherein a depth of the at least one longitudinal groove is approximately equal to one-quarter of a wavelength associated with an operating frequency at which a maximum amount of current is flowing in the transverse direction.

21. The broadband horn antenna of claim 20, wherein the depth of the longitudinal groove is approximately equal to one-half of the thickness of the inner surface.

22. The broadband horn antenna of claim 17, wherein the at least one longitudinal groove formed within each inner surface of the pair of conductive antenna elements comprises a plurality of longitudinal grooves, which are formed parallel to one another and to similar depths.

23. The broadband horn antenna of claim 17, further comprising a pair of tapered extension elements, each coupled to an outer surface of a different one of the pair of conductive antenna elements at one end thereof, wherein the pair of tapered extension elements extend in opposite directions along an axis, which is perpendicular to a longitudinal axis separating the pair of conductive antenna elements, and wherein the pair of tapered extension elements function to suppress current flow along the outer surfaces.

24. The broadband horn antenna of claim 23, wherein no additional structures, other than the tapered extension elements, are coupled to the outer surfaces of the pair of conductive antenna elements.

* * * * *